United States Patent [19]

Sakai

[11] 4,163,922

[45] Aug. 7, 1979

[54] MAGNETRONS

[75] Inventor: Masao Sakai, Mobara, Japan

[73] Assignee: Hitachi, Ltd., Tokyo, Japan

[21] Appl. No.: 880,095

[22] Filed: Feb. 22, 1978

[30] Foreign Application Priority Data

Jun. 24, 1977 [JP] Japan ..... 52/82498[U]

[51] Int. Cl.[2] ..... H01J 25/50

[52] U.S. Cl. ..... 315/39.71; 315/39.51

[58] Field of Search ..... 315/39.51, 39.71

[56] References Cited

U.S. PATENT DOCUMENTS

| | | | |
|---|---|---|---|
| 3,984,725 | 10/1976 | Cook et al. | 315/39.51 |
| 3,989,979 | 11/1976 | Konno et al. | 315/39.51 |
| 4,027,194 | 5/1977 | Yamano et al. | 315/39.51 |
| 4,044,279 | 8/1977 | Tsuzurahara et al. | 315/39.51 |

*Primary Examiner*—Saxfield Chatmon, Jr.
*Attorney, Agent, or Firm*—Charles E. Pfund

[57] ABSTRACT

In a magnetron wherein permanent magnets are contained in an evacuated envelope formed by an anode cylinder and yokes on the opposite ends thereof, gaskets made of relatively soft metal are interposed between the permanent magnets and component elements adjoining thereto.

6 Claims, 7 Drawing Figures

MAGNETRONS

BACKGROUND OF THE INVENTION

This invention relates to a magnetron, more particularly to a magnetron of the type wherein permanent magnets are contained in a sealed evacuated vessel.

This type of magnetron is disclosed in Japanese patent laid open specification No. 114162/1975 and U.S. Pat. No. 4,042,851 for example. According to the construction of the magnetron of this type since it is possible to dispose the permanent magnets close to the interaction space defined between the cathode electrode and anode vanes it is possible to decrease the leakage flux in the magnetic path. As a consequence, it is possible to efficiently utilize the magnetic flux generated by the permanent magnets and hence to decrease the size thereof and the magnetron.

With this type of magnetron, however, as a yoke disposed adjacent an antenna conductor and adapted to support one surface of a magnet, a pole piece secured to the other surface of the magnet, supporting members of the magnet and pole piece, and an antenna support are utilized as a microwave transmission circuit for deriving the output from the magnetron, unless the material, dimensions and surface treatments of these component parts are controlled strictly, the following problems occur.

More particularly, unless the component parts are maintained in an intimate electrical contact, electric field concentrates at poorly contacted portions to form electric spark. This causes power loss, decreases output efficiency and emits gas due to heat. This degrades the electron emission characteristic of the cathode filament thereby causing such abnormal phenomena as moding and degrading the stability and reliability of the magnetron.

Magnets utilized in these magnetrons are usually made of cast Alnico (trade name) or a samarium-cobalt alloy but the magnetization characteristics of these materials deteriorate when the temperature exceeds 500° C. or 600° C.

For the purpose of obviating these problems it has been the practice to finish at high accuracies the permanent magnets and component parts connected thereto which increases the cost of the magnetron. However, since the pole pieces are generally formed by press working soft steel sheets, the pole pieces tend to flex after working and when such flex occurs, electric field concentrates at a gap formed by the flexed pole piece. When foreign matter may happen to be interposed between the permanent magnet and a member connected thereto, field concentration also occurs.

SUMMARY OF THE INVENTION

Accordingly, it is the principal object of this invention to provide a reliable and inexpensive magnetron capable of preventing the loss of high frequency energy caused by incomplete contact between component parts and the deterioration of the filament caused by released gas thereby improving the operating efficiency of the magnetron.

According to this invention, there is provided a magnetron comprising an anode cylinder, a pair of yokes secured to the opposite ends of the anode cylinder, the anode cylinder and the yokes forming an evacuated envelope, a plurality of vanes radially extending from the inner wall of the anode cylinder to define an interaction space, a cathode structure disposed in the interaction space, a supporting member secured to the inner wall of the anode cylinder, a permanent magnet and a pole piece interposed between one of the yokes and the supporting member, wherein a gasket, made of relatively soft electroconductive metal, is interposed between the permanent magnet and member adjoining thereto.

BRIEF DESCRIPTION OF THE DRAWINGS

In the accompanying drawings:

FIGS. 2A and 2B, FIGS. 3A and 3B and FIGS. 4A and 4B show examples of the gasket embodying the invention in which FIGS. 2A, 3A and 4A are sectional views and FIGS. 2B, 3B and 4B are plan views.

DESCRIPTION OF THE PREFERRED EMBODIMENTS

Figure 1:
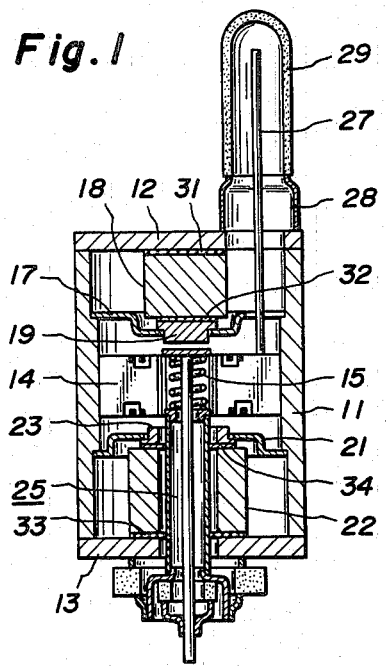
FIG. 1 is a longitudinal sectional view showing one example of a magnetron embodying the invention.
Figure 2A:
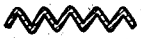
Figure 3A:
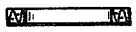
Figure 4A:
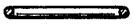
Figure 2B:
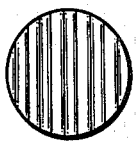
Figure 3B:
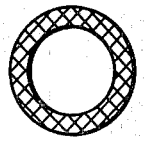
Figure 4B:
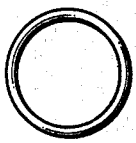

A preferred embodiment of this invention shown in FIG. 1 comprises an anode cylinder 11 made of magnetic material and yokes 12 and 13 made of magnetic material and secured to the opposite ends of the anode cylinder to define a sealed evacuated space. A plurality of anode vanes 14 are disposed within the evacuated space and the outer ends of the vanes are secured to the inner wall of the anode cylinder. A cathode electrode is disposed concentrically with the anode cylinder in an interaction space defined by the inner ends of the vanes.

A cylindrical permanent magnet 18 and a pole piece 19 are disposed between the lower surface of the upper yoke 12 and a dish shaped pole piece supporting member 17. The purpose of containing the permanent magnet in the evacuated space is to dispose the magnet close as possible to the interaction space to minimize the leakage flux of the magnetic path and to miniaturize the magnet.

Between the inner wall of the yoke 13 and a dish shaped pole piece supporting member 21 secured to the inner wall of the anode cylinder 11 are interposed an annular shaped permanent magnet 22 and a pole piece 23 thereof. The cathode electrode 15 is connected to an external source through a combined support and lead including a filament and end shields which constitute a stem structure 25.

An antenna 27 extends through the upper yoke 12 and the upper end of the antenna is covered by a metal cylinder 28 and a cup shaped insulator 29.

According to the invention, gaskets 31, 32, 33 and 34 are interposed respectively between yoke 12 and magnet 18, between pole piece 19 and magnet 18, between yoke 13 and magnet 22 and between pole piece 23 and magnet 22. These gaskets are made of soft electroconductive metals such as copper, silver and aluminum. FIGS. 2A, 2B, 3A, 3B, 4A and 4B show typical examples of the gasket. The gasket shown in FIGS. 2A and 2B takes the form of a corrugated metal sheet. Instead of providing corrugations, irregularities may be formed. In the case in FIGS. 3A and 3B the gasket takes the form of an annular disc formed by braiding fine metal wires. The gasket shown in FIGS. 4A and 4B takes the form of a metal wire ring.

When the gaskets described above are applied to the opposite surfaces of the permanent magnets 18 and 22, the contacts between the magnets and the pole pieces comprise a plurality of point contacts or line or plane contacts instead a single point contact so that more intimate contacts are formed therebetween. For this reason, different from the prior art construction, there is no fear of generating electric spark and heat, thus effectively preventing the loss of high frequency energy caused by poor contact and improving the operating efficiency of the magnetron. This also prevents deterioration of the filament due to the release of gas so that the operating stability and the reliability of the magnetron can be improved. Accordingly, it is possible to fabricate the permanent magnets with low heat resistant material, for example ferrite, for the purpose of decreasing the manufacturing cost of the magnetron.

What is claimed is:

1. In a magnetron comprising an anode cylinder, a pair of yokes secured to the opposite ends of said anode cylinder, said anode cylinder and said yokes forming an evacuated envelope, a plurality of vanes radially extending from the linear wall to said anode cylinder to define an interaction space, a cathode structure disposed in said interaction space, a supporting member secured to the inner wall of said anode cylinder, a permanent magnet and a pole piece interposed between one of said yokes and said supporting member, the improvement which comprises gaskets made of relatively soft electroconductive metal and interposed between said permanent magnet and members adjoining thereto.

2. The magnetron according to claim 1 wherein said gaskets are interposed respectively between said permanent magnet and said one yoke and between said permanent magnet and said pole piece.

3. The magnetron according to claim 1 wherein each gasket takes the form of a corrugated disc.

4. The magnetron according to claim 1 wherein each gasket takes the form of an annular mesh disc.

5. The magnetron according to claim 1 wherein each gasket takes the form of a metal wire ring.

6. The magnetron according to claim 1 wherein two spaced apart supporting members are connected to the inner wall of said anode cylinder and a permanent magnet and a pole piece are interposed between each one of the yokes and each one of the supporting members.

* * * * *